US005298090A

United States Patent [19]

Garg et al.

[11] Patent Number: 5,298,090

[45] Date of Patent: Mar. 29, 1994

[54] ATMOSPHERES FOR HEAT TREATING NON-FERROUS METALS AND ALLOYS

[75] Inventors: Diwakar Garg, Macungie; Brian B. Bonner, Nesquehoning; Donald P. Eichelberger, Macungie; Kerry R. Berger, Lehighton, all of Pa.

[73] Assignee: Air Products and Chemicals, Inc., Allentown, Pa.

[21] Appl. No.: 995,617

[22] Filed: Dec. 22, 1992

[51] Int. Cl.[5] ..... F27D 23/00; C21D 1/00

[52] U.S. Cl. ..... 148/208; 148/216; 148/218; 266/81

[58] Field of Search ..... 148/208, 216, 218; 266/81

[56] References Cited

U.S. PATENT DOCUMENTS

| | | | |
|---|---|---|---|
| 4,445,945 | 5/1984 | Schwalm | 148/216 |
| 4,531,984 | 7/1985 | Madsac et al. | 148/218 |
| 4,931,070 | 6/1990 | Prasad | 55/16 |
| 4,992,113 | 2/1991 | Baldo et al. | 148/216 |
| 5,045,126 | 9/1991 | Comier et al. | 148/218 |
| 5,057,164 | 10/1991 | Nelsson et al. | 148/16 |
| 5,069,728 | 12/1991 | Rancon et al. | 148/16 |
| 5,160,380 | 11/1992 | Vocke et al. | 148/206 |
| 5,242,509 | 9/1993 | Rancon et al. | 148/206 |

FOREIGN PATENT DOCUMENTS

| | | |
|---|---|---|
| 2639249 | 5/1990 | France . |
| 2639251 | 5/1990 | France . |

OTHER PUBLICATIONS

P. F. Stratton, The Use of Non-Cryogenically Produced Nitrogen in Furnace Atmosphere 1989, pp. 63-67.

P. F. Stratton, A Cost-Effective Nitrogen-Based Atmosphere for Copper Annealing 1990, pp. 93-97.

*Primary Examiner*—Upendra Roy

*Attorney, Agent, or Firm*—James C. Simmons; William F. Marsh

[57] ABSTRACT

A process for producing low-cost atmospheres suitable for annealing, brazing, and sintering non-ferrous metals and alloys from non-cryogenically produced nitrogen containing up to 5%, residual oxygen is disclosed. According to the process, suitable atmospheres are produced by 1) pre-heating the non-cryogenically produced nitrogen stream containing residual oxygen to a desired temperature, 2) mixing it with more than a stoichiometric amount a hydrocarbon gas, 3) passing it through a reactor packed with a platinum group of metal catalyst to reduce the residual oxygen to very low levels and convert it to a mixture of moisture and carbon dioxide, and 4) using the reactor effluent stream for annealing, brazing, and sintering non-ferrous metals and alloys in a furnace. The key features of the disclosed process include 1) pre-heating the non-cryogenically produced nitrogen containing residual oxygen to a certain minimum temperature, 2) adding more than a stoichiometric amount of a hydrocarbon gas to the preheated nitrogen stream, and 3) using a platinum group of metal catalyst to initiate and sustain the reaction between oxygen and the hydrocarbon gas.

7 Claims, 2 Drawing Sheets

ATMOSPHERES FOR HEAT TREATING NON-FERROUS METALS AND ALLOYS

FIELD OF THE INVENTION

The present invention pertains to heat treating non-ferrous metals and alloys in a controlled furnace atmosphere.

BACKGROUND OF THE INVENTION

Nitrogen-based atmospheres have been routinely used by the heat treating industry both in batch and continuous furnaces since the mid 1970s. Because of low dew point and virtual absence of carbon dioxide, nitrogen-based atmospheres do not exhibit oxidizing and decarburizing properties and are therefore suitable for a variety of heat treating operations. More specifically, a mixture of nitrogen and hydrogen has been used extensively for bright annealing non-ferrous metals and alloys such as copper and gold.

A major portion of nitrogen used by the heat treating industry has been produced by distillation of air in large cryogenic plants. The cryogenically produced nitrogen is generally pure and expensive. To reduce the cost of nitrogen, several non-cryogenic air separation techniques such as adsorption and permeation have been recently developed and introduced in the market. The non-cryogenically produced nitrogen is indeed inexpensive, but it contains 0.2 to 5%, residual oxygen, making a direct substitution of cryogenically produced nitrogen with non-cryogenically produced nitrogen in heat treating furnaces very difficult, if not impossible.

Attempts have been made to use reducing gases such as a hydrocarbon and hydrogen along with non-cryogenically produced nitrogen to produce atmospheres suitable for heat treating or bright annealing parts in furnaces but with limited success even with the use of an excess amount of a reducing gas. The problem has generally been related to surface oxidation of the heat treated or annealed parts in the furnace.

A mixture of non-cryogenically produced nitrogen and hydrogen has been used for annealing copper and described in papers titled, "The Use of Non-Cryogenically Produce Nitrogen in Furnace Atmospheres", published in Heat Treatment of Metals, pages 63–67, March 1989 and "A Cost Effective Nitrogen-Based Atmosphere for Copper Annealing", published in Heat Treatment of Metals, pages 93–97, April 1990. These papers describe that a heat treated copper product was slightly discolored when all the gaseous feed containing a mixture of hydrogen and non-cryogenically produced nitrogen with residual oxygen was introduced into the heating zone of a continuous furnace. It is, therefore, clearly evident that according to the prior art, copper cannot be bright annealed with a mixture of non-cryogenically produced nitrogen and hydrogen in continuous furnaces.

U.S. Pat. No. 5,057,164 discloses and claims a method for producing an atmosphere suitable for heat treating metals from non-cryogenically produced nitrogen in continuous furnaces by reacting residual oxygen with hydrogen or carbon monoxide in the heating zone followed by extracting a part of the atmosphere from the heating zone and introducing it into the cooling zone of the furnace. Unfortunately, this process requires a large amount of hydrogen or carbon monoxide to provide a high $pH_2/pH_2O$ or $pCO/pCO_2$ ratio (or reducing environment) in the furnace, making it uneconomical for bright annealing, brazing, and sintering non-ferrous metals and alloys.

Researchers have explored numerous alternative ways of using noncryogenically produced nitrogen for heat treating metals in continuous furnaces. For example, furnace atmospheres suitable for bright annealing copper, brazing copper, and sintering copper and copper alloys have reportedly been generated from non-cryogenically produced nitrogen by converting residual oxygen to moisture with hydrogen gas in external units prior to feeding atmospheres into the furnaces. Such atmosphere generation methods have been disclosed in detail in U.S. Pat. No. 3,535,074, Australian Patent Applications AU45561/89 and AU45562/89 dated Nov. 24, 1988, and European Patent Application 90306645.4 dated Jun. 19, 1990. Unfortunately, these processes are not cost-effective because they require expensive hydrogen to maintain a reducing environment in the furnace.

U.S. Pat. No. 4,931,070 and French Patent Publications 2,639,249 and 2,639,251 dated Nov. 24, 1988 disclose and claim processes for producing atmospheres suitable for heat treating metals from non-cryogenically produced nitrogen by converting residual oxygen to moisture with hydrogen in external catalytic units followed by extraction of moisture prior to introducing the atmosphere into a furnace. These methods are not cost effective because they 1) require expensive hydrogen to maintain a reducing environment in the furnace and 2) there are significant costs associated with extracting moisture from the atmosphere.

U.S. Pat. No. 5,069,728 discloses and claims a process for producing atmospheres suitable for heat treating from non-cryogenically produced nitrogen by simultaneously introducing 1) non-cryogenically produced nitrogen along with hydrogen and carbon monoxide in the heating zone and 2) non-cryogenically produced nitrogen pretreated to convert the residual oxygen to moisture with hydrogen in an external catalytic reactor or nitrogen gas free of oxygen in the cooling zone of a continuous furnace. Unfortunately, this method requires expensive hydrogen or carbon monoxide to maintain reducing environment in the furnace, making it uneconomical for bright annealing, brazing, and sintering non-ferrous metals and alloys.

Based upon the above discussion, it is clear that there is a need for processes for generating low-cost atmospheres for bright annealing, brazing, and sintering non-ferrous metals and alloys from non-cryogenically produced nitrogen. Additionally, there is a need to develop processes which are cost effective and eliminate the need of expensive hydrogen gas.

SUMMARY OF THE INVENTION

This invention discloses a process for producing low-cost atmospheres suitable for bright annealing, brazing, and sintering non-ferrous metals and alloys from non-cryogenically produced nitrogen. According to the process, atmospheres suitable for annealing, brazing, and sintering non-ferrous metals and alloys are produced by 1) pre-heating the non-cryogenically produced nitrogen stream containing residual oxygen to a desired temperature, 2) mixing it with more than a stoichiometric amount of a hydrocarbon gas, 3) passing it through a reactor packed with a platinum group of metal catalyst to reduce the residual oxygen to very low levels by converting it to a mixture of moisture and carbon dioxide.

According to the invention, copper and copper alloys are bright annealed and brazed by 1) pre-heating the non-cryogenically produced nitrogen stream containing residual oxygen to a desired temperature, 2) mixing it with a hydrocarbon gas such as natural gas or propane, 3) flowing the mixture through a catalytic reactor to convert residual oxygen to a mixture of moisture and carbon dioxide, and 4) introducing the reactor effluent stream containing a mixture of nitrogen, moisture, carbon dioxide, and unreacted hydrogen gas into the furnace. The flow rate of a hydrocarbon gas is controlled in a such way that it is more than the stoichiometric amount required for the complete conversion of residual oxygen to a mixture of moisture and carbon dioxide.

Atmospheres produced according to the present invention are also suitable for sintering non-ferrous metals and alloys.

DETAILED DESCRIPTION OF THE INVENTION

Figure 1:
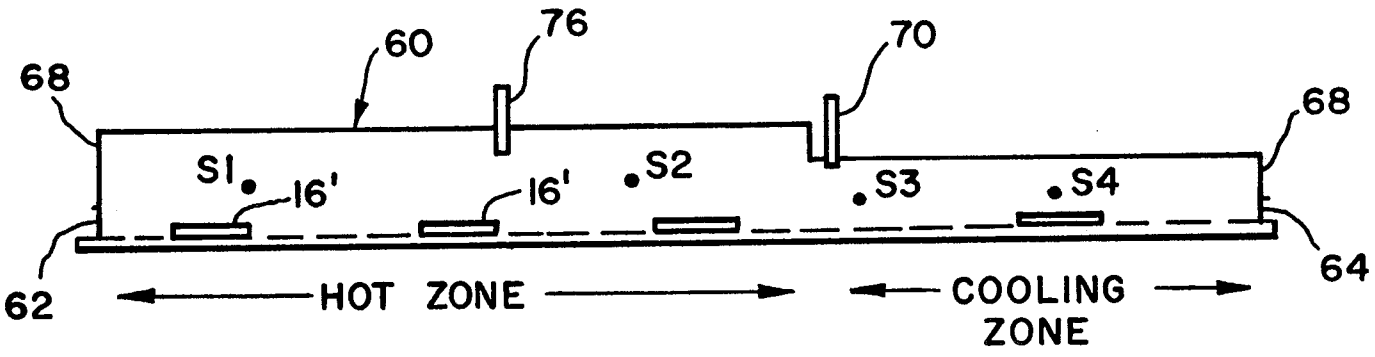
FIG. 1 is a schematic representation of a furnace used to test the heat treating process according to the present invention.

The present invention discloses a process for producing low-cost atmospheres suitable for heat treating non-ferrous metals and alloys from non-cryogenically produced nitrogen. The process of the present invention is based on the surprising discovery that atmospheres suitable for bright annealing, brazing, and sintering non-ferrous metals and alloys can be produced by 1) pre-heating the non-cryogenically produced nitrogen stream containing residual oxygen to a desired temperature, 2) mixing it with a hydrocarbon gas such as natural gas or propane, 3) flowing the mixture through a catalytic reactor to convert residual oxygen to a mixture of moisture and carbon dioxide, and 4) introducing the reactor effluent stream containing a mixture of nitrogen, moisture, carbon dioxide, and unreacted hydrocarbon gas into the furnace.

Nitrogen gas produced by cryogenic distillation of air has been widely employed in many heat treating applications. Cryogenically produced nitrogen is substantially free of oxygen (oxygen content has generally been less than 10 ppm) and expensive. Therefore, there has been a great demand, especially by the heat treating industry, to generate nitrogen inexpensively for heat treating applications. With the advent of non-cryogenic technologies for air separation such as adsorption and permeation, it is now possible to produce nitrogen gas inexpensively. The non-cryogenically produced nitrogen, however, is contaminated with up to 5% residual oxygen, which is generally undesirable for many heat treating applications. The presence of residual oxygen has made the direct substitution of cryogenically produced nitrogen with that produced by non-cryogenic techniques very difficult.

The residual oxygen in non-cryogenically produced nitrogen for the process of the present invention can vary from 0.05%, to about 5%, preferably from about 0.1%, to about 3%, and ideally from about 0.1% to about 1.0%.

The non-cryogenically produced nitrogen stream is pre-heated to a temperature ranging from about 200° to 400° C., preferably to between 225° to 350° C. The pre-heating temperature required depends on the reactivity and the nature of the hydrocarbon gas used. For example, the pre-heating temperature required with propane is considerably lower than the one required with methane or natural gas. Since the reaction between residual oxygen and a hydrocarbon gas is exothermic in nature, it is advisable to limit the pre-heating temperature to below about 400° C. to avoid the thermal cracking of the hydrocarbon gas and the deposition of coke on the catalyst. Instead of pre-heating feed gas, the catalytic reactor can be heated directly to the desired temperature.

The amount of a hydrocarbon gas required for converting residual oxygen to a mixture of moisture and carbon dioxide in the presence of a platinum group of metal catalyst is more than a stoichiometric amount required for converting completely oxygen to a mixture of moisture and carbon dioxide. It is advisable not to use far excess of hydrocarbon to avoid the thermal cracking of the hydrocarbon gas and the deposition of coke on the catalyst. Preferably, the amount of a hydrocarbon gas required for converting residual oxygen to a mixture of moisture and carbon dioxide in an external catalytic reactor is 1.5 times the stoichiometric amount or more.

The hydrocarbon gas can be selected from alkanes such as methane, ethane, propane, and butane and alkenes such as ethylene, propylene, and butene. Commercial feedstocks such as natural gas, petroleum gas, cooking gas, coke oven gas, and town gas can also be used as a hydrocarbon.

The catalytic reactor is packed with a precious metal catalyst supported on a high surface area support material made of alumina, magnesia, zirconia, silica, titania, or mixtures thereof. The precious metal catalyst can be selected from platinum group metals such as platinum, palladium, rhodium, ruthenium, iridium, osmium, or mixtures thereof. The metal concentration in the catalyst can vary from about 0.05 to about 1.0% by weight. Preferably, the metal concentration is between 0.2 to 0.5% by weight and is selected from palladium, platinum, or mixtures thereof supported on a high surface area alumina. Metal catalyst can be shaped in the form of pellets or balls. Commercially available palladium and platinum metal based catalysts such as Type 30196-29 supplied by GPT, Inc., Manalapan, N.J., RO-20, RO-21, and RO-22 supplied by BASF Corporation, Parsippany, N.J., and Type 48, 50, 50A, 50B, 54, and 73 supplied by Johnson Matthey, Wayne, Pa. can also be used for deoxygenating nitrogen stream.

The precious metal catalyst can optionally be supported on a metallic or a ceramic honeycomb structure to avoid problems related to pressure drop through the reactor. Once again the precious metal catalyst supported on this structure can be selected from platinum group metals such as platinum, palladium, rhodium, ruthenium, iridium, osmium, or mixtures thereof. The cell density in the honeycomb structure can vary from about 100 to 400 cells per square inch. A cell density above about 200 cells per square inch is especially preferable. The metal concentration in the catalyst can vary from about 0.05 to about 1.0% by weight (or from about 10 to 30 mg precious metal per cubic foot of catalyst volume). Preferably, the catalyst is approximately from about 0.2 to 0.5 wt %, palladium or a mixture of platinum and palladium in the metal form supported on honeycomb structure. The honeycomb structure can be similar to the one described in a technical brochure "VOC destruction through catalytic incineration" published by Johnson Matthey, Wayne, Pa. It can also be similar to the ones described in technical brochures "High Performance Catalytic Converters With Metal Cores" published by Camet Co., Hiram, Ohio and "Celcor (registered trade mark of Corning) Honeycomb Catalysts Support" published by Corning, N.Y.

The hourly flow rate of gaseous mixture flowing through the catalytic reactor can vary from about 100 to 50,000 times the volume of the reactor. It can preferably vary from about 1,000 to 20,000 times the volume of the reactor. More preferably, it can vary from about 2,000 to 10,000 times the volume of the reactor.

The effluent stream from the catalytic reactor containing a mixture of nitrogen, moisture, carbon dioxide, unreacted hydrocarbon gas, and less than 10 ppm residual oxygen is introduced into the heating and/or cooling zone of a furnace through an open tube for heat treating non-ferrous metals and alloys. The internal diameter of the open tube can vary from 0.25 in. to 5 in. The open tube can be inserted in the heating or the cooling zone of the furnace through the top, sides, or the bottom of the furnace depending upon the size and the design of the furnace.

The effluent gas stream from the catalytic reactor can also be introduced into the heating zone of a furnace through a device that prevents the direct impingement of feed gas containing a mixture of moisture and carbon dioxide on the parts. Such devices are shown in FIG. 3 of U.S. patent application Ser. No. 07/727,806, filed Jul. 8, 1991, the specification of which is incorporated herein by reference.

In addition to using devices in accord with the above application, a flow directing plate or a device facilitating mixing of hot gases present in the furnace with the feed gas can also be used.

A continuous furnace with separate heating and cooling zones is most suitable for the process of the invention. It can be operated at atmospheric or above atmospheric pressure for the process of the invention. The continuous furnace can be of the mesh belt, a roller hearth, a pusher tray, a walking beam, or a rotary hearth type. The continuous furnace can optionally be equipped with a pure nitrogen gas (containing less than 10 ppm oxygen) curtain at the end of the cooling zone (discharge end) to avoid infiltration of air from the outside through the discharge vestibule. Furthermore, a pure oxygen-free nitrogen stream such as the one produced by vaporizing liquid nitrogen can optionally be used in the cooling zone of the furnace.

A continuous furnace with a heating zone and an integrated quench cooling zone is also ideal for the present invention. It can be operated at atmospheric or above atmospheric pressure. The continuous furnace can be of the mesh belt, shaker, a roller hearth, a pusher tray, a shaker hearth, a rotary retort, or a rotary hearth type. A pure oxygen-free nitrogen stream such as the one produced by vaporizing liquid nitrogen can optionally be used in the quench cooling zone of the furnace to prevent infiltration of air from the outside.

A batch furnace is also ideal for annealing and sintering of nonferrous metals and alloys according to the present invention.

The operating temperature of the heat treating furnace should be at least 300° C.

The catalytic reactor effluent gas can be fed directly into the heating zone of a continuous furnace with a separate cooling zone or an integrated quench cooling zone, saving heating requirements for the furnace. The effluent gas can be used to pre-heat the gaseous feed mixture prior to introducing it into the catalytic reactor. The effluent gas can be cooled using a heat exchanger and fed into the transition zone located between the heating and cooling zone or into the cooling zone of a continuous furnace with a separate cooling zone. Finally, the effluent gas can be divided into two or more streams and fed into the heating and cooling zones of a continuous furnace with a separate cooling zone. It can also be introduced into the furnace through multiple injection ports located in the heating and cooling zones.

The reactor effluent gas can also be fed directly into the batch furnace. Alternatively, it can be cooled prior to introducing into the batch furnace. Preferably, the effluent gas is introduced directly into the batch furnace without any cooling during the heating cycle to assist in heating parts. Additionally, it is cooled prior to introducing into the batch furnace during the cooling cycle to assist in cooling parts.

Copper and copper alloys that can be annealed and brazed according to the present invention can be selected from the groups C101 to C782 as described in Table A, pages 7-2 to 7-2 of Metals Handbook, Desk Edition, published by American society of Metals (Fifth printing, October 1989. Nickel-copper alloys such as Monel, gold alloys, and cobalt based alloys such as Haynes and Stellite can also be heat treated according to process disclosed in this invention. The copper based powders that can be sintered according to the present invention can be selected from Cu, Cu-Zn with up to 40% Zn, Cu-Pb-Zn with up to 4% Pb and 40% Zn, Cu-Sn-Zn with up to 10%, Sn and 40%, Zn, Cu-Sn-Pb-Zn with up to 4% Pb, 10% Sn, and 40% Zn, Cu-Si with up to 4% Si, Cu-Zn-Mn with up to 40% Zn and 3% Mn, Cu-Al, Cu-Al-Fe, Cu-Al-Si, Cu-Fe-Zn-Sn-Mn, Cu-Zn-Al-Co, Cu-Al-Ni-Zn, Cu-Zn-Si, Cu-Fe-Ni-Mn, Cu-Fe-Ni, Cu-Ni with up to 30% Ni, Cu-Zn-Ni with up to 30% Zn and 20% Ni, Cu-Zn-Cr-Fe-Mn, and Cu-Pb-Zn-Ni. Other elements such as P, Cd, Te, Mg, Ag, Zr, $Al_2O_3$, etc. can optionally be added to the copper-based powders to obtain the desired properties in the final sintered product. Additionally, they can be mixed with up to 2% carbon to provide lubricity to the final sintered product. Finally, they can be mixed with up to 2% zinc stearate to help in pressing parts from them.

Two different external catalytic reactors were used to convert residual oxygen present in the non-cryogenically produced nitrogen with a hydrocarbon gas. A small 1 in. diameter reactor packed with approximately 0.005 $ft^3$ of precious metal catalyst was used initially to study the reaction between residual oxygen and a hydrocarbon gas. After these initial experiments, a 3 in. diameter reactor with 0.0736 $ft^3$ of catalyst was designed and integrated with a heat treating furnace to demonstrate the present invention. The effluent stream from the catalytic reactor was introduced into either the shock zone (transition zone) or the heating zone of the furnace for the heat treating experiments.

Figure 2:
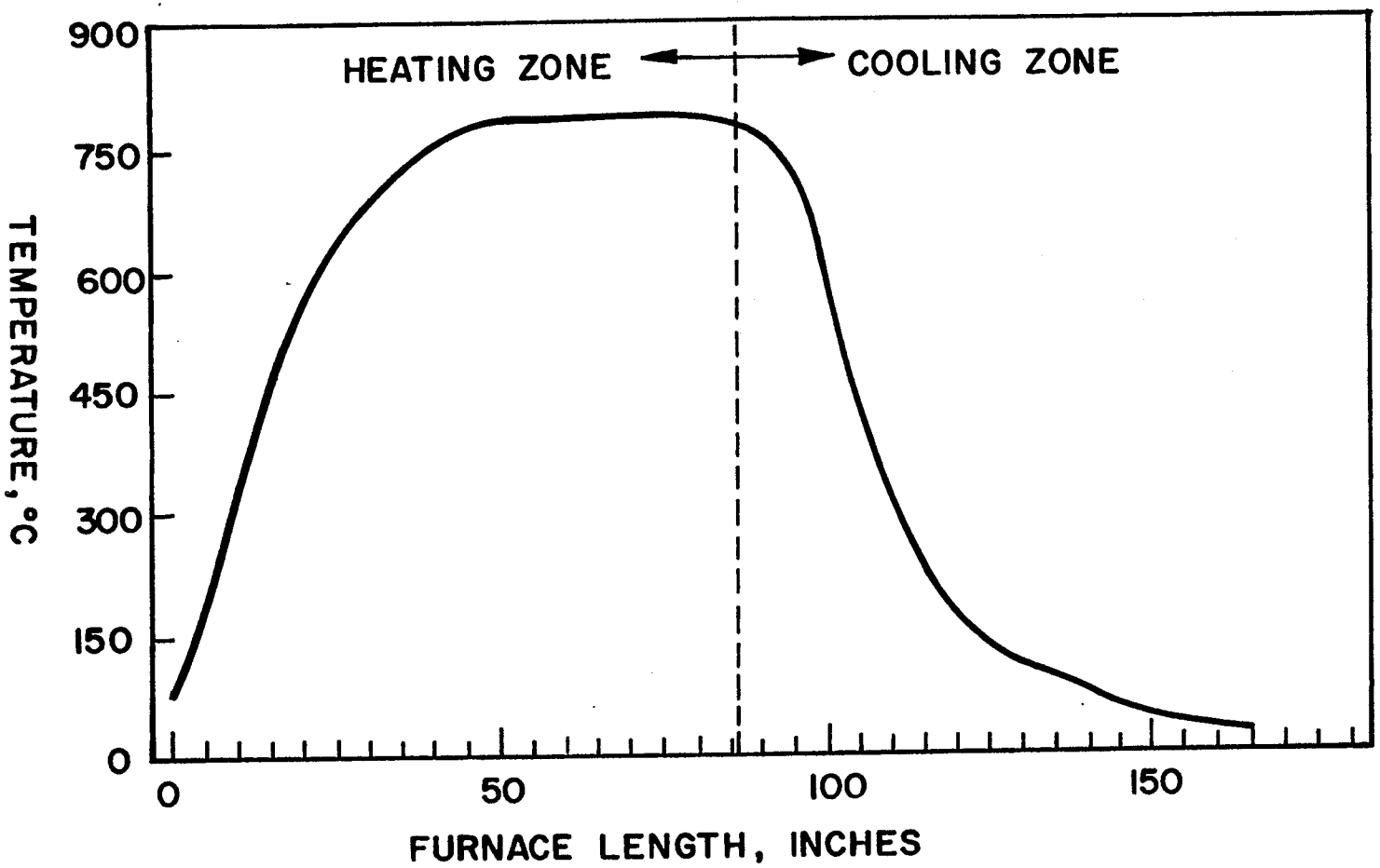
FIG. 2 is a plot of temperature against length of the furnace illustrating the experimental furnace profile for a heat treating temperature of 750° C.

A Watkins-Johnson conveyor belt furnace capable of operating up to a temperature of 1,150° C. was used in all the heat treating experiments. The heating zone of the furnace consisted of 8.75 inches wide, about 4.9 inches high, and 86 inches long Inconel 601 muffle heated resistively from the outside. The cooling zone, made of stainless steel, was 8.75 inches wide, 3.5 inches high, and 90 inches long and was water cooled from the outside. A 8.25 inches wide flexible conveyor belt supported on the floor of the furnace was used to feed the samples to be heat treated through the heating and cooling zones of the furnace. A fixed belt speed of 6 inches per minute was used in all the experiments. The furnace shown schematically as 60 in FIG. 1 was equipped with physical curtains 62 and 64 both on entry 66 and exit 68 sections to prevent air from entering the furnace. The gaseous feed mixture containing nitrogen, moisture, carbon dioxide, unreacted hydrogen, and less than 10 ppm oxygen was introduced into the transition zone (shock zone) located at 70 through an open tube or into the heating zone through an open tube or an introduction device selected from FIGS. 3A to 3F of U.S. Pat. No. 5,221,369 the specification of which is incorporated herein by reference placed at location 76 in the heating zone of the furnace during heat treating experiments. The shock zone feeding area 70 was located immediately after the heating zone of the furnace, as shown in FIG. 1. The other feeding area 76 was located in the heating zone 40 in. away from the transition zone, as shown in FIG. 1. This feed area was located well into the hottest section of the heating zone as shown by the furnace temperature profile depicted in FIG. 2 obtained at 750° C. normal furnace operating temperature with 350 SCFH of pure nitrogen flowing into furnace 60. The temperature profiles show a rapid cooling of the parts as they move out of the heating zone and enter the cooling zone. Rapid cooling of the parts is commonly used by the heat treating industry to help in preventing oxidation of the parts from high levels of moisture and carbon dioxide in the cooling zone.

Table 1 and the following text set forth the results of deoxygenation trials in a 1 in. diameter reactor with natural gas with the catalyst supported on a metallic honeycomb structure.

non-cryogenic separation techniques. The amount of natural gas used was equal to the stoichiometric amount required to convert oxygen completely to a mixture of moisture and carbon dioxide. The hourly flow rate of nitrogen stream through the reactor was 10,000 times the volume of the catalyst in the reactor (Gas Hourly Space Velocity or GHSV of 10,000 l/h).

The feed gas was pre-heated to a temperature varying from 255° to about 371° C., as shown in Table 1. The effluent stream from the reactor contained more than 900 ppm oxygen when the feed gas was pre-heated to a temperature as high as 371° C. This example showed that a feed gas temperature substantially greater than 371° C. is required to remove oxygen from nitrogen stream with a stoichiometric amount of natural gas.

EXAMPLE 1B

The catalytic deoxygenation experiment described in Example 1A was repeated using the same reactor, type of catalyst, flow rate of nitrogen stream (or GHSV of 10,000 l/h), and composition of nitrogen stream with the exception of using 0.5% by volume natural gas. The amount of natural gas used was 2 times the stoichiometric amount required to convert oxygen completely to a mixture of moisture and carbon dioxide. The reactor effluent stream contained less than 5 ppm oxygen when the feed stream was pre-heated to about 362° C. temperature, as shown in Table 1. The residual oxygen was converted to a mixture of moisture and carbon dioxide. This example showed that a feed gas temperature close to 362° C. is required to remove oxygen from nitrogen stream with two times the stoichiometric amount of natural gas.

EXAMPLE 1C

The catalytic deoxygenation experiment described in Example 1A was repeated using the same reactor, type of catalyst, flow rate of nitrogen stream (or GHSV of

TABLE 1

| | Example 1A | | | Example 1B | | | Example 1C | |
|---|---|---|---|---|---|---|---|---|
| Flow Rate of Feed Gas, SCFH | | 50 | | | 50 | | | 50 |
| Composition of Feed Gas | | | | | | | | |
| Nitrogen, % | | 99.5 | | | 99.5 | | | 99.5 |
| Oxygen, % | | 0.5 | | | 0.5 | | | 0.5 |
| Catalyst Type | | (1) | | | (1) | | | (1) |
| GHSV, 1/h | | 10,000 | | | 10,000 | | | 10,000 |
| Amount of Natural Gas Added, % | | 0.25 | | | 0.50 | | | 1.00 |
| Feed Gas Temperature, °C. | 225 | 289 | 371 | 260 | 319 | 362 | 263 | 307 |
| Effluent Gas Composition | | | | | | | | |
| Oxygen, ppm | 3,930 | 1,200 | 922 | 3,370 | 32 | <5 | 2,590 | <9 |
| Carbon Dioxide, % | 0.05 | 0.19 | 0.20 | 0.08 | 0.25 | 0.25 | 0.12 | 0.25 |
| Dew Point, °C. | −20 | −5 | −5 | −15 | −2 | −2 | −11 | −2 |
| Methane, % | 0.22 | 0.06 | 0.04 | 0.42 | 0.25 | 0.25 | 0.88 | 0.75 |

(1) 0.2% Platinum/Palladium supported on Metallic Honeycomb.

EXAMPLE 1A

A nitrogen stream containing 0.5% (5,000 ppm) oxygen was heated to a desired temperature using a preheater. It was then mixed with 0.25% natural gas (containing predominately methane) and deoxygenated by passing the gaseous feed mixture through a 1 in. diameter catalytic reactor packed with 0.2% platinum metal catalyst supported on a metallic honeycomb structure with a cell density of approximately 200 cells/in.$^2$. The honeycomb catalyst was supplied by Johnson Matthey of Wayne, Pa. The composition of nitrogen used in this example was similar to that commonly produced by 10,000 l/h), and composition of nitrogen stream with the exception of using 1.0% by volume natural gas. The amount of natural gas used was 4 times the stoichiometric amount required to convert oxygen completely to a mixture of moisture and carbon dioxide. The reactor effluent stream contained less than 9 ppm oxygen when the feed stream was pre-heated to about 307° C. temperature, as shown in Table 1. This example showed that a feed gas temperature close to 310° C. is required to remove oxygen from nitrogen stream with four times the stoichiometric amount of natural gas.

Examples 1A to 1C showed that the platinum group of metals can be used to reduce oxygen level in the feed nitrogen stream to below 10 ppm level provided the feed stream is pre-heated to a temperature close to 310° C. and added with more than a stoichiometric amount of natural gas.

Table 2 and the following discussion set out details of deoxygenation trials in 1 in. diameter reactor with propane with the catalyst supported on a metallic honeycomb structure.

TABLE 2

| | Example 2A | | | Example 2B | | | Example 2C | | |
|---|---|---|---|---|---|---|---|---|---|
| Flow Rate of Feed Gas, SCFH | 50 | | | 50 | | | 50 | | |
| Composition of Feed Gas | | | | | | | | | |
| Nitrogen, % | 99.5 | | | 99.5 | | | 99.5 | | |
| Oxygen, % | 0.5 | | | 0.5 | | | 0.5 | | |
| Catalyst Type | 0.2 Platinum/Palladium Supported on Metallic Honeycomb | | | 0.2 Platinum/Palladium Supported on Metallic Honeycomb | | | 0.2 Platinum/Palladium Supported on Metallic Honeycomb | | |
| GHSV, 1/h | 10,000 | | | 10,000 | | | 10,000 | | |
| Amount of Propane Added, % | 0.13 | | | 0.24 | | | 0.35 | | |
| Feed Gas Temperature, °C. | 168 | 187 | 229 | 174 | | 219 | 182 | | 215 |
| Effluent Gas Oxygen Level, ppm | 4,600 | 2,790 | <4 | 2,090 | | <3 | 617 | | <4 |

EXAMPLE 2A

The catalytic deoxygenation experiment described in Example 1A was repeated using the same reactor, type of catalyst, composition of nitrogen stream, and flow rate of nitrogen (or GHSV of 10,000 1/h) with the exception of using 0.13% by volume propane. The amount of propane used was about 1.3 times the stoichiometric amount required to convert oxygen completely to a mixture of moisture and carbon dioxide.

The feed gas was pre-heated to a temperature varying from 168° to about 229° C., as shown in Table 2. The effluent gas from the reactor contained more than 2,500 ppm oxygen when feed gas was pre-heated to a temperature close to 187° C. it, however, contained less than 4 ppm oxygen when feed gas was pre-heated to about 229° C. temperature, as shown in Table 2. This example showed that feed nitrogen needs to be pre-heated close to 229° C. to reduce oxygen level below 10 ppm with slightly more than a stoichiometric amount of propane.

EXAMPLES 2B AND 2C

The catalytic deoxygenation experiment described in Example 2A was repeated twice using the same reactor, type of catalyst, flow rate of nitrogen stream (or GHSV of 10,000 1/h), and composition of nitrogen stream with the exception of using 0.24% and 0.35% by volume propane, respectively. The amount of propane used in these examples was 2.4 and 3.5 times the stoichiometric amount required to convert oxygen completely to a mixture of carbon dioxide and moisture. The reactor effluent stream contained less than 3 ppm oxygen when feed stream was pre-heated to about 219° C. temperature, as shown in Table 2. These examples showed that feed nitrogen needs to be pre-heated close to 220° C. temperature to reduce oxygen level below 10 ppm with more than two times the stoichiometric amount of propane.

Table 3 and the related discussion set forth deoxygenation trials in a 1 in. diameter reactor with propane with the catalyst supported on alumina pellets.

TABLE 3

| | Example 3A | | | Example 3B | | | Example 3C | | |
|---|---|---|---|---|---|---|---|---|---|
| Flow Rate of Feed Gas, SCFH | 50 | | | 50 | | | 50 | | |
| Composition of Feed Gas | | | | | | | | | |
| Nitrogen, % | 99.5 | | | 99.5 | | | 99.5 | | |
| Oxygen, % | 0.5 | | | 0.5 | | | 0.5 | | |
| Catalyst Type | 0.5% Palladium Supported on Alumina Pellets | | | 0.5% Palladium Supported on Alumina Pellets | | | 0.5% Palladium Supported on Alumina Pellets | | |
| GHSV, 1/h | 10,000 | | | 10,000 | | | 10,000 | | |
| Amount of Propane Added, % | 0.13 | | | 0.24 | | | 0.35 | | |
| Feed Gas Temperature, °C. | 228 | 274 | 301 | 277 | | 292 | 233 | | 278 |
| Effluent Gas Oxygen Level, ppm | 4,680 | 3,560 | <3 | 2,100 | | <2 | 4,280 | | <4 |

EXAMPLE 3A

The catalytic deoxygenation experiment described in Example 2A was repeated using the same reactor, composition of nitrogen stream, and flow rate of nitrogen (or GHSV of 10,000 1/h) with the exceptions of using 0.13% by volume propane and 0.5% palladium metal catalyst supported on high surface area alumina pellets. The amount of propane used was about 1.3 times the stoichiometric amount required to convert oxygen completely to a mixture of moisture and carbon dioxide.

The feed nitrogen stream was pre-heated to a temperature varying from 228° to about 301° C., as shown in Table 3. The effluent gas from the reactor contained more than 3,500 ppm oxygen when feed nitrogen was pre-heated to a temperature close to 274° C. It, however, contained less than 3 ppm oxygen when feed nitrogen was pre-heated to about 301° C. temperature, as shown in Table 3. This example showed that feed nitrogen needs to be pre-heated close to 301° C. to reduce oxygen level below 10 ppm with more than a stoichiometric amount of propane in the presence of platinum group of metal catalyst supported on alumina pellets.

EXAMPLES 3 AND 3C

The catalytic deoxygenation experiment described in Example 3A was repeated twice using the same reactor, type of catalyst, flow rate of nitrogen stream (or GHSV of 10,000 1/h), and composition of nitrogen stream with the exception of using 0.24% and 0.35% by volume propane, respectively. The amount of propane used was 2.4 and 3.5 times the stoichiometric amount required to convert oxygen completely to a mixture of moisture and carbon dioxide. The reactor effluent gas contained less than 4 ppm oxygen when feed nitrogen was pre-heated to about 292° C. temperature, as shown in Table 3. These examples showed that feed nitrogen needs to be pre-heated close to 292° C. temperature to reduce oxygen level below 10 ppm with more than two times the stoichiometric amount of propane in the presence of platinum group of metal catalyst supported on alumina pellets.

Table 4 and the text following the presentation of the data set out results of deoxygenation trials in 3 in. diameter reactor with natural gas catalyst supported on alumina pellets on a metallic honeycomb structure.

TABLE 4

| | Example 4 | Example 5 |
|---|---|---|
| Flow Rate of Feed Gas, SCFH | 350 | 350 |
| Composition of Feed Gas | | |
| Nitrogen, % | 99.5 | 99.5 |
| Oxygen, % | 0.5 | 0.5 |
| Catalyst Type | 0.5% Palladium Supported on Alumina Pellets | 0.5% Platinum/Palladium Supported on Metallic Honeycomb |
| GHSV, 1/h | 4,750 | 4,750 |
| Amount of Natural Gas Added, % | 1.5 | 0.5 |
| Feed Gas Temperature, °C. | 330 | 320 |
| Effluent Gas Oxygen Level, ppm | <2 | <7 |

EXAMPLE 4

A 350 SCFH flow of nitrogen stream containing 0.5% (5,000 ppm) oxygen was pre-heated to a temperature close to 330° C. It was then mixed with 1.5% natural gas (containing predominately methane) and deoxygenated by passing through a 3" diameter reactor packed with 0.5% palladium metal catalyst supported on high surface area alumina pellets. The catalyst was supplied by Johnson Matthey of Wayne, Pa. The amount of natural gas used was six times the stoichiometric amount required to convert oxygen completely to a mixture of moisture and carbon dioxide. The hourly flow rate of nitrogen stream through the reactor was 4,750 times the volume of the reactor (Gas Hourly Space Velocity or GHSV of 4,750 1/h), as shown in Table 4. The effluent gas from the reactor contained less than 2 ppm oxygen. This example showed that feed nitrogen needs to be pre-heated to about 330° C. to reduce oxygen level below 10 ppm with natural gas in the presence of a platinum group of metal catalyst supported on alumina.

EXAMPLE 5

The catalytic deoxygenation experiment described in Example 4 was repeated using a similar reactor, composition of nitrogen stream, and flow rate of nitrogen stream (or GHSV of 4,750 1/h) with the exceptions of pre-heating the feed nitrogen to 320° C. temperature, adding 0.5% natural gas, and using 0.5% platinum plus palladium metal catalyst supported on a metallic honeycomb structure, as shown in Table 4. The catalyst was supplied by Johnson Matthey of Wayne, Pa. The reactor effluent gas contained less than 7 ppm oxygen. This example showed that feed nitrogen needs to pre-heated to about 320° C. to reduce oxygen level below 10 ppm with natural gas in the presence of a platinum group of metal catalyst supported on a metallic honeycomb structure.

Tables 5, 6 and 7 set forth the results of copper samples heat treated in non-cryogenically produced nitrogen according to the present invention.

EXAMPLE 6

The catalytic deoxygenation experiment described in Example 5 was repeated using a similar reactor, type of catalyst, composition of nitrogen stream, flow rate of nitrogen stream (or GHSV of 4,750 1/h), and the amount of natural gas (0.5%) with the exception of pre-heating the feed nitrogen to 290° C. temperature. The reactor effluent gas contained less than 5 ppm oxygen. Additionally, it contained 0.25% unreacted natural gas, 0.25% carbon dioxide, and 0.50% moisture.

The reactor effluent stream was introduced into the transition zone (located between the heating and cooling zones) of the Watkins-Johnson furnace to heat treat non-ferrous metal samples in several examples summarized in Table 5 and described below.

TABLE 5

| | Example 6A | Example 6B | Example 6C | Example 6D | Example 6E |
|---|---|---|---|---|---|
| Experiment No. | 12160-69-01 | 12160-70-02 | 12160-70-03 | 12160-70-04 | 12160-72-06 |
| Heat Treating Temperature, °C. | 600 | 650 | 700 | 750 | 827 |
| Feed Gas Location | Transition Zone | Transition Zone | Transition Zone | Transition Zone | Transition Zone |
| Feed Gas Device | Open Tube | Open Tube | Open Tube | Open Tube | Open Tube |
| Feed Gas Composition | | | | | |
| Residual Oxygen, ppm | <8 | <8 | <8 | <8 | <8 |
| Carbon Dioxide, % | 0.25 | 0.25 | 0.25 | 0.25 | 0.25 |
| Natural Gas, % | 0.25 | 0.25 | 0.25 | 0.25 | 0.25 |
| Moisture, % | 0.50 | 0.50 | 0.50 | 0.50 | 0.50 |
| Quality of Heat Treated Samples | Uniform Bright | Uniform Bright | Uniform Bright | Uniform Bright | Good Quality Sintered Samples |

EXAMPLE 6A

The reactor effluent gas stream from Example 6 was introduced into the transition zone of the Watkins-Johnson furnace operated at ~600° C. to anneal copper samples. The samples treated in this example were annealed with a uniform, bright surface finish, as shown in Table 5. This example showed that a non-ferrous metal such as copper can be bright annealed at 600° C. in non-cryogenically produced nitrogen that has been deoxygenated with a hydrocarbon gas in an external catalytic reactor.

EXAMPLE 6B TO 6D

Example 6A was repeated three times to anneal copper samples in the furnace operated at 650°, 700°, and 750° C. temperatures, as shown in Table 5. The samples treated in these examples were annealed with a uniform, bright surface finish, as shown in Table 5. These examples showed that non-ferrous metal such as copper can be bright in non-cryogenically produced nitrogen that has been deoxygenated with a hydrocarbon gas in an external catalytic reactor.

EXAMPLE 6E

The reactor effluent gas stream from Example 6 was introduced into the transition zone of the Watkins-Johnson furnace operated at ~827° C. to sinter samples made of bronze powder. The samples contained ~0.75% zinc stearate and ~1.0% carbon. They were not delubed prior to sintering. The samples were sintered with a surface finish similar to that observed with a similar sample sintered in pure nitrogen-hydrogen atmosphere. Cross-sectional analysis of a sintered sample showed it to have a microstructure similar to that noted with a similar sample sintered in pure nitrogen-hydrogen atmosphere. The physical dimensions of the sintered samples were well within the specified limits. Furthermore, they were very similar to those noted with a similar sample sintered in pure nitrogen-hydrogen atmosphere. This example showed that a non-cryogenically produced nitrogen atmosphere that has been deoxygenated with a hydrocarbon gas in an external catalytic reactor can be used to sinter copper alloys.

EXAMPLE 7

The catalytic deoxygenation experiment described in Example 6 was repeated using the identical conditions. The reactor effluent gas contained less than 5 ppm oxygen. Additionally, it contained 0.25% unreacted natural gas, 0.25% carbon dioxide, and 0.50% moisture.

The reactor effluent stream was introduced into the heating zone of the Watkins-Johnson furnace through a porous diffuser to heat treat non-ferrous metal samples in several examples summarized in Table 6 and described below.

EXAMPLE 7A

The reactor effluent stream from Example 7 was used to anneal copper samples at 600° C. in the furnace. It was introduced into the heating zone of the furnace (location 76 in FIG. 1) through a porous generally cylindrical shaped diffuser comprising a top half of ¾ in. diameter, 6 in. long porous Inconel material with a total of 96, 1/16 in. diameter holes. The size and number of holes in the diffuser were selected in a way that it provided uniform flow of gas through each hole. The bottom half of diffuser was a gas impervious Inconel with one end of diffuser capped and the other end attached to a ½ in. diameter stainless steel feed tube inserted into the furnace 60 through the cooling end vestibule 68. The bottom half 46 of diffuser 40 was positioned parallel to the parts 16' being treated thus essentially directing the flow of feed gas towards the hot ceiling of the furnace. The diffuser therefore helped in preventing the direct impingement of feed gas on the parts.

The samples treated in these examples were annealed with a uniform, bright surface finish, as shown in Table 6. This example showed that non-ferrous metal such as copper can be bright in non-cryogenically produced nitrogen that has been deoxygenated with a hydrocarbon gas in an external catalytic reactor.

EXAMPLE 7B TO 7D

Example 7A was repeated three times to anneal copper samples in the furnace operated at 650°, 700°, and 750° C. temperatures, as shown in Table 6. The samples treated in these examples were annealed with a uniform, bright surface finish, as shown in Table 6. These examples showed that non-ferrous metal such as copper can be bright in non-cryogenically produced nitrogen that has been deoxygenated with a hydrocarbon gas in an external catalytic reactor.

EXAMPLE 7E

The reactor effluent gas stream from Example 7 was introduced into the heating zone of the Watkins-Johnson furnace operated at ~827° C. through a device similar to the one used in Example 7A to sinter samples made of bronze powder. The samples contained ~0.75% zinc stearate and ~1.0% carbon. They were not delubed prior to sintering. The samples were sintered with a surface finish similar to that observed with a similar sample sintered in pure nitrogen-hydrogen atmosphere. Cross-sectional analysis of a sintered sample showed it to have a microstructure similar to that noted with a similar sample sintered in pure nitrogen-hydrogen atmosphere. The physical dimensions of the sintered samples were well within the specified limits. Furthermore, they were very similar to those noted with a similar sample sintered in pure nitrogen-hydrogen atmosphere. This example showed that a non-cryogenically produced nitrogen atmosphere that has been deoxygenated with a hydrocarbon gas in an external catalytic reactor can be used to sinter copper alloys.

TABLE 6

| | Example 7A | Example 7B | Example 7C | Example 7D | Example 7E |
|---|---|---|---|---|---|
| Experiment No. | 12160-76-15 | 12160-76-16 | 12160-77-17 | 12160-77-18 | 12160-78-20 |
| Heat Treating Temperature, °C. | 600 | 650 | 700 | 750 | 827 |
| Feed Gas Location | Heating Zone | Heating Zone | Heating Zone | Heating Zone | Heating Zone |
| Feed Gas Device | Diffuser | Diffuser | Diffuser | Diffuser | Diffuser |
| Feed Gas Composition | | | | | |
| Residual Oxygen, ppm | <5 | <5 | <5 | <5 | <5 |
| Carbon Dioxide, % | 0.25 | 0.25 | 0.25 | 0.25 | 0.25 |
| Natural Gas, % | 0.25 | 0.25 | 0.25 | 0.25 | 0.25 |
| Moisture, % | 0.50 | 0.50 | 0.50 | 0.50 | 0.50 |
| Quality of Heat Treated Samples | Uniform Bright | Uniform Bright | Uniform Bright | Uniform Bright | Good Quality Sintered Samples |

EXAMPLE 8

The catalytic deoxygenation experiment described in Example 6 was repeated using a similar reactor, type of catalyst, composition of nitrogen stream, flow rate of nitrogen stream (or GHSV of 4,750 l/h), and pre-heating the feed nitrogen to 290° C. temperature with the exception of using 1.0% natural gas. The reactor effluent gas contained less than 5 ppm oxygen. Additionally, it contained 0.75% unreacted natural gas, 0.25% carbon dioxide, and 0.50% moisture.

The reactor effluent stream was introduced into the heating zone of the Watkins-Johnson furnace through a porous diffuser to heat treat non-ferrous metal samples in several examples summarized in Table 7 and described below.

TABLE 7

| | Example 8A | Example 8B | Example 8C | Example 8D |
|---|---|---|---|---|
| Experiment No. | 12160-86-01 | 12160-86-02 | 12160-87-04 | 12160-86-18 |
| Heat Treating Temperature, °C. | 600 | 650 | 700 | 750 |
| Feed Gas Location | Heating Zone | Heating Zone | Heating Zone | Heating Zone |
| Feed Gas Device | Diffuser | Diffuser | Diffuser | Diffuser |
| Feed Gas Composition | | | | |
| Residual Oxygen, ppm | <5 | <5 | <5 | <5 |
| Carbon Dioxide, % | 0.25 | 0.25 | 0.25 | 0.25 |
| Natural Gas, % | 0.25 | 0.25 | 0.25 | 0.25 |
| Moisture, % | 0.50 | 0.5 | 0.50 | 0.50 |
| Quality of Heat Treated Samples | Uniform Bright | Uniform Bright | Uniform Bright | Uniform Bright |

EXAMPLE 8A

The reactor effluent stream from Example 8 was used to anneal copper samples at 600° C. in the furnace. It was introduced into the heating zone of the furnace through a porous diffuser similar to the one described in Example 7A.

The samples treated in these examples were annealed with a uniform, bright surface finish, as shown in Table 7. This example showed that non-ferrous metal such as copper can be bright in non-cryogenically produced nitrogen that has been deoxygenated with a hydrocarbon gas in an external catalytic reactor.

EXAMPLE 8B TO 8D

Example 8A was repeated three times to anneal copper samples in the furnace operated at 650°, 700°, and 750° C. temperatures, as shown in Table 7. The samples treated in these examples were annealed with a uniform, bright surface finish, as shown in Table 7. These examples showed that non-ferrous metal such as copper can be bright in non-cryogenically produced nitrogen that has been deoxygenated with a hydrocarbon gas in an external catalytic reactor.

Examples 6A to 6E, 7A to 7E, and 8A to 8D showed that a non-cryogenically produced nitrogen deoxygenated with a hydrocarbon gas in an external catalytic reactor can be used to bright anneal non-ferrous metals such as copper and sinter parts made of non-ferrous metal powders such as bronze. These examples also showed that the deoxygenated stream can be introduced into the transition zone or the heating zone of the furnace for annealing or sintering non-ferrous parts.

Having thus described our invention, what is desired to be secured by Letters Patent of the United States is set forth in the appended claims.

We claim:

1. A process for generating an atmosphere for use in a heat treating furnace used for annealing, brazing, or sintering non-ferrous metals and alloys comprising the steps of:

pre-heating a non-cryogenically produced nitrogen stream containing up to 5% by volume residual oxygen to a temperature between 200° C. and 400° C.;

mixing the pre-heated non-cryogenically produced nitrogen stream with a hydrocarbon gas said hydrocarbon gas present in an amount in excess of that required for stoichiometric conversion of oxygen contained in said nitrogen stream;

passing said mixture over a platinum group metal catalyst contained in a reactor;

recovery from said reactor an effluent consisting essentially of nitrogen containing carbon dioxide, moisture, unreacted hydrocarbons and less than 10 ppm oxygen; and introducing said effluent into the furnace used to heat treat metals and alloys where the presence of unreacted hydrocarbons, carbon dioxide and moisture in the nitrogen will not affect inerting properties of the nitrogen.

2. A process according to claim 1 wherein the catalyst is contained in a reactor heated to a temperature between 200° C. and 400° C.

3. A process according to claim 1 wherein the effluent is heat exchanged with the non-cryogenically produced nitrogen stream to effect at least partial pre-heating of the non-cryogenically produced nitrogen stream.

4. A process according to claim 1 wherein the hydrocarbon gas is selected from the group comprising methane, ethane, propane, butane, ethylene, propylene, butene and mixtures thereof.

5. A process according to claim 1 wherein the catalyst is selected from the group comprising supported platinum, palladium or mixture thereof when the metal concentration is between 0.05 and 1.0 per unit by weight.

6. A process according to claim 1 wherein the amount of excess hydrocarbon mixed with the non-cryogenically produced nitrogen controlled to prevent thermal cracking of the hydrocarbon and deposition of coke on the catalyst.

7. A process according to claim 1 wherein the amount of hydrocarbon gas added to the nitrogen is at least 1.5 times the stiochiometric amount required.

* * * * *